US009384759B2

(12) United States Patent
Zakarauskas et al.

(10) Patent No.: US 9,384,759 B2
(45) Date of Patent: Jul. 5, 2016

(54) VOICE ACTIVITY DETECTION AND PITCH ESTIMATION

(75) Inventors: Pierre Zakarauskas, Vancouver (CA); Alexander Escott, Vancouver (CA); Clarence S. H. Chu, Vancouver (CA); Shawn E. Stevenson, Burnaby (CA)

(73) Assignee: Malaspina Labs (Barbados) Inc., Upton, St. Michael (BB)

( * ) Notice: Subject to any disclaimer, the term of this patent is extended or adjusted under 35 U.S.C. 154(b) by 566 days.

(21) Appl. No.: 13/590,022

(22) Filed: Aug. 20, 2012

(65) Prior Publication Data

US 2013/0231932 A1 Sep. 5, 2013

Related U.S. Application Data

(60) Provisional application No. 61/606,891, filed on Mar. 5, 2012.

(51) Int. Cl.
*G10L 21/00* (2013.01)
*G10L 25/00* (2013.01)
(Continued)

(52) U.S. Cl.
CPC ..... *G10L 25/78* (2013.01); *G10L 25/93* (2013.01); *G10L 25/18* (2013.01); *G10L 25/90* (2013.01)

(58) Field of Classification Search
CPC ..... G10L 25/78; G10L 25/93; G10L 25/84; G10L 21/0232; G10L 15/20; G10L 19/00; G10L 19/012; G10L 19/0208; G10L 19/08; G10L 19/10; G10L 19/24; G10L 2021/02165; G10L 15/00; G10L 19/002; G10L 19/005; G10L 19/06
USPC ..... 704/208, 207, 233, 234
See application file for complete search history.

(56) References Cited

U.S. PATENT DOCUMENTS 3,989,896 A 11/1976 Reitboeck
4,515,158 A * 5/1985 Patrick ..... A61F 11/04 607/57

(Continued)

FOREIGN PATENT DOCUMENTS

WO 03096031 A2 11/2003

OTHER PUBLICATIONS

Milenkovic, P., "Glottal inverse filtering by joint estimation of an AR system with a linear input model," Acoustics, Speech and Signal Processing, IEEE Transactions on , vol. 34, No. 1, pp. 28,42, Feb. 1986.*

(Continued)

*Primary Examiner* — Michael Ortiz Sanchez

(57) ABSTRACT

Implementations include systems, methods and/or devices operable to detect voice activity in an audible signal by detecting glottal pulses. The dominant frequency of a series of glottal pulses is perceived as the intonation pattern or melody of natural speech, which is also referred to as the pitch. However, as noted above, spoken communication typically occurs in the presence of noise and/or other interference. In turn, the undulation of voiced speech is masked in some portions of the frequency spectrum associated with human speech by the noise and/or other interference. In some implementations, detection of voice activity is facilitated by dividing the frequency spectrum associated with human speech into multiple sub-bands in order to identify glottal pulses that dominate the noise and/or other inference in particular sub-bands. Additionally and/or alternatively, in some implementations the analysis is furthered to provide a pitch estimate of the detected voice activity.

15 Claims, 6 Drawing Sheets

(51) Int. Cl.

| | |
|---|---|
| ***G10L 25/93*** | (2013.01) |
| ***G10L 15/00*** | (2013.01) |
| ***G10L 15/20*** | (2006.01) |
| ***G10L 25/78*** | (2013.01) |
| *G10L 25/90* | (2013.01) |
| *G10L 25/18* | (2013.01) |

(56) References Cited

U.S. PATENT DOCUMENTS

| | | | | |
|---|---|---|---|---|
| 4,561,102 | A | 12/1985 | Prezas | |
| 5,995,147 | A * | 11/1999 | Suzuki | H04H 20/30 348/469 |
| 6,104,992 | A | 8/2000 | Gao et al. | |
| 6,199,035 | B1 | 3/2001 | Lakaniemi et al. | |
| 6,459,914 | B1 * | 10/2002 | Gustafsson et al. | 455/570 |
| 6,611,800 | B1 | 8/2003 | Nishiguchi et al. | |
| 6,691,092 | B1 * | 2/2004 | Udaya Bhaskar et al. | 704/265 |
| 6,978,235 | B1 | 12/2005 | Ozawa | |
| 7,013,269 | B1 * | 3/2006 | Bhaskar et al. | 704/219 |
| 7,149,682 | B2 * | 12/2006 | Yoshioka et al. | 704/205 |
| 7,219,065 | B1 * | 5/2007 | Vandali | G10L 21/0364 704/200.1 |
| 7,643,994 | B2 | 1/2010 | Kemp | |
| 2001/0021904 | A1 | 9/2001 | Plumpe | |
| 2003/0002659 | A1 * | 1/2003 | Erell | 379/387.01 |
| 2004/0128130 | A1 * | 7/2004 | Rose et al. | 704/236 |
| 2005/0149321 | A1 | 7/2005 | Kabi et al. | |
| 2008/0133225 | A1 | 6/2008 | Yamada | |
| 2009/0036170 | A1 * | 2/2009 | Unno | H04M 9/082 455/570 |
| 2009/0182556 | A1 * | 7/2009 | Reckase et al. | 704/208 |
| 2009/0240491 | A1 | 9/2009 | Reznik | |
| 2009/0271183 | A1 * | 10/2009 | Nyquist et al. | 704/211 |
| 2009/0271196 | A1 * | 10/2009 | Nyquist et al. | 704/246 |
| 2009/0287481 | A1 | 11/2009 | Paranjpe et al. | |
| 2010/0046770 | A1 * | 2/2010 | Chan | H04R 3/005 381/92 |
| 2010/0232616 | A1 | 9/2010 | Chamberlain et al. | |
| 2011/0044405 | A1 | 2/2011 | Sasaki et al. | |
| 2011/0081026 | A1 | 4/2011 | Ramakrishnan et al. | |
| 2012/0004909 | A1 | 1/2012 | Beltman et al. | |
| 2012/0130713 | A1 * | 5/2012 | Shin et al. | 704/233 |
| 2013/0022223 | A1 * | 1/2013 | Kehtarnavaz | H04R 25/70 381/317 |
| 2013/0278318 | A1 * | 10/2013 | Kwon | G01R 19/04 327/309 |

OTHER PUBLICATIONS

International Search Report for PCT/IB2013/000805 dated Dec. 12, 2013.

International Search Report for PCT/IB2013/000802 dated Jan. 23, 2014.

International Search Report for PCT/IB2013/000888 dated May 15, 2014.

Extended European Search Report for corresponding European Appl. No. 13758687 dated Sep. 1, 2015.

* cited by examiner

VOICE ACTIVITY DETECTION AND PITCH ESTIMATION

RELATED APPLICATIONS

This application claims the benefit of U.S. Provisional Patent Application No. 61/606,891, entitled "Voice Activity Detection and Pitch Estimation," filed on Mar. 5, 2012, and which is incorporated by reference herein.

TECHNICAL FIELD

The present disclosure generally relates to speech signal processing, and in particular, to voice activity detection and pitch estimation from a noisy audible signal.

BACKGROUND

The ability to recognize and interpret the speech of another person is one of the most heavily relied upon functions provided by the human sense of hearing. But spoken communication typically occurs in adverse acoustic environments including ambient noise, interfering sounds, background chatter and competing voices. As such, the psychoacoustic isolation of a target voice from interference poses an obstacle to recognizing and interpreting the target voice. Multi-speaker situations are particularly challenging because voices generally have similar average characteristics. Nevertheless, recognizing and interpreting a target voice is a hearing task that unimpaired-hearing listeners are able to accomplish effectively, which allows unimpaired-hearing listeners to engage in spoken communication in highly adverse acoustic environments. In contrast, hearing-impaired listeners have more difficultly recognizing and interpreting a target voice even in low noise situations.

Previously available hearing aids typically utilize methods that improve sound quality in terms of the ease of listening (i.e., audibility) and listening comfort. However, the previously known signal enhancement processes utilized in hearing aids do not substantially improve speech intelligibility beyond that provided by mere amplification, especially in multi-speaker environments. One reason for this is that it is particularly difficult using previously known processes to electronically isolate one voice signal from competing voice signals because, as noted above, competing voices have similar average characteristics. Another reason is that previously known processes that improve sound quality often degrade speech intelligibility, because, even those processes that aim to improve the signal-to-noise ratio, often end up distorting the target speech signal. In turn, the degradation of speech intelligibility by previously available hearing aids exacerbates the difficulties hearing-impaired listeners have in recognizing and interpreting a target voice.

SUMMARY

Various implementations of systems, methods and devices within the scope of the appended claims each have several aspects, no single one of which is solely responsible for the desirable attributes described herein. Without limiting the scope of the appended claims, some prominent features are described herein. After considering this discussion, and particularly after considering the section entitled "Detailed Description" one will understand how the features of various implementations are used to enable detecting voice activity in an audible signal, and additionally and/or alternatively, providing a pitch estimate of the detected voice signal.

To those ends, some implementations include systems, methods and/or devices operable to detect voice activity in an audible signal by detecting periodically occurring pulse peaks in an audible signal. These periodically occurring pulse peaks are typically referred to as glottal pulses, because they are the result of the periodic opening and closing of the glottis. The dominant pulse rate of a series of glottal pulses is perceived as the intonation pattern or melody of natural speech, which is also referred to as the pitch. That is, the glottal pulses provide an underlying undulation to voiced speech corresponding to the perceived pitch. However, as noted above, spoken communication typically occurs in the presence of noise and/or other interference. In turn, the undulation of voiced speech is masked in some portions of the frequency spectrum associated with human speech by noise and/or other interference. In some implementations, detection of voice activity is facilitated by dividing the frequency spectrum associated with human speech into multiple sub-bands in order to identify glottal pulses that dominate the noise and/or other inference in particular sub-bands. Glottal pulses may be more pronounced in sub-bands that include relatively higher energy speech formants that have energy envelopes that vary according to glottal pulses. Additionally and/or alternatively, in some implementations the analysis is furthered to provide a pitch estimate of the detected voice activity.

Some implementations include a method of detecting voice activity in an audible signal. In some implementations, the method includes converting an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands; identifying at least one pulse pair in the plurality of time-frequency units having a relatively consistent spacing over multiple time intervals on a sub-band basis, wherein the presence of a pulse pair is indicative of voiced speech; and providing a voice activity signal indicator based at least in part on the presence of a pulse pair.

Some implementations include a voice activity detector operable to provide an indication of whether voiced sounds are present in an audible signal. In some implementations the voice activity detector is also operable to provide a pitch estimate of a detected voice signal.

In some implementations, the voice activity detector includes a conversion module configured to convert an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands; a peak detection module configured to identify one or more pulses as candidate glottal pulses in the envelope of the frequency-domain signal for each interval; an accumulation module configured to sum one or more pulse pairs having a given separation over sequential intervals on a sub-band basis; and a pulse pair detection module configured to identify at least one pulse pair in the accumulation of one or more pulses. In some implementations, the voice activity detector also includes a disambiguation filter configured to disambiguate between a signal component indicative of pitch and a signal component indicative of an integer or fractional multiple of the pitch; a low pass filter configured to filter the output of the disambiguation filter; and a pulse identification module configured to identify the highest amplitude pulse after low pass filtering, wherein the highest amplitude pulse is indicative of a dominant voice period in the audible signal.

Additionally and/or alternatively, in some implementations, a voice activity detector includes means for converting an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands; means for identifying one or more pulses as candidate glottal pulses in the envelope of the frequency-domain signal for each interval; means for accumulating one or more pulse pairs having a given separation over sequential intervals on a sub-band basis; and means for identifying at least one pulse pair in the accumulation of one or more pulses.

Additionally and/or alternatively, in some implementations a voice activity detector includes a processor and a memory including instructions. When executed, the instructions cause the processor to convert an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands; identify one or more pulses as candidate glottal pulses in the envelope of the frequency-domain signal for each interval; accumulate one or more pulse pairs having a given separation over sequential intervals on a sub-band basis; and identify at least one pulse pair in the accumulation of one or more pulses.

BRIEF DESCRIPTION OF THE DRAWINGS

So that the present disclosure can be understood in greater detail, a more particular description may be had by reference to the features of various implementations, some of which are illustrated in the appended drawings. The appended drawings, however, illustrate only some example features of the present disclosure and are therefore not to be considered limiting, for the description may admit to other effective features.

Figure 1A:
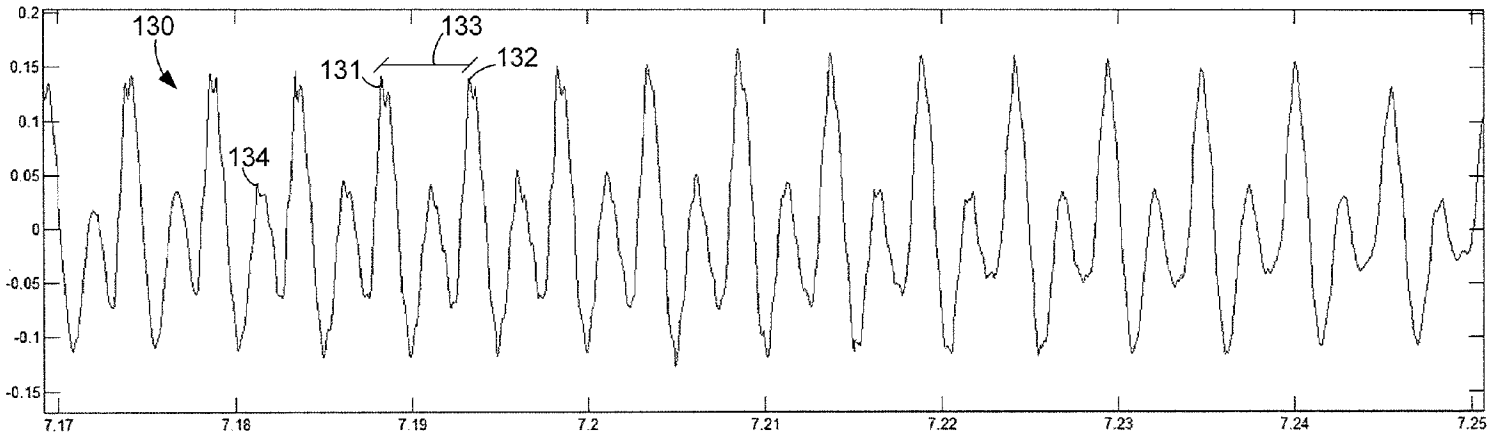
FIG. 1A is a time domain representation of a simulated example glottal pulse train.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

The various implementations described herein enable to voice activity detection and pitch estimation for speech signal processing, such as for example, speech signal enhancement provided by a hearing aid device or the like. In particular, some implementations include systems, methods and/or devices operable to detect voice activity in an audible signal by detecting glottal pulses in the frequency spectrum associated with human speech. Additionally and/or alternatively, in some implementations the analysis is furthered to provide a pitch estimate of the detected voice activity.

Numerous details are described herein in order to provide a thorough understanding of the example implementations illustrated in the accompanying drawings. However, the invention may be practiced without these specific details. And, well-known methods, procedures, components, and circuits have not been described in exhaustive detail so as not to unnecessarily obscure more pertinent aspects of the example implementations.

The general approach of the various implementations described herein is to enable detection of voice activity in a noisy signal by dividing the frequency spectrum associated with human speech into multiple sub-bands in order to identify glottal pulses that dominate noise and/or other inference in particular sub-bands. Glottal pulses may be more pronounced in sub-bands that include relatively higher energy speech formants that have energy envelopes that vary according to glottal pulses.

In some implementations, the detection of glottal pulses is used to signal the presence of voiced speech because glottal pulses are an underlying component of how voiced sounds are created by a speaker and subsequently perceived by a listener. To that end, glottal pulses are created when air pressure from the lungs is buffeted by the glottis, which periodically opens and closes. The resulting pulses of air excite the vocal track, throat, mouth and sinuses which act as resonators, so that the resulting voiced sound has the same periodicity as the train of glottal pulses. By moving the tongue and vocal chords the spectrum of the voiced sound is changed to produce speech which can be represented by one or more formants, which are discussed in more detail below. However, the aforementioned periodicity of the glottal pulses remains and provides the perceived pitch of voiced sounds.

The duration of one glottal pulse is representative of the duration of one opening and closing cycle of the glottis, and the fundamental frequency of a series of glottal pulses is approximately the inverse of the interval between two subsequent pulses. The fundamental frequency of a glottal pulse train dominates the perception of the pitch of a voice (i.e., how high or low a voice sounds). For example, a bass voice has a lower fundamental frequency than a soprano voice. A typical adult male will have a fundamental frequency of from 85 to 155 Hz, and that of a typical adult female from 165 to 255 Hz. Children and babies have even higher fundamental frequencies. Infants show a range of 250 to 650 Hz, and in some cases go over 1000 Hz.

During speech, it is natural for the fundamental frequency to vary within a range of frequencies. Changes in the fundamental frequency are heard as the intonation pattern or melody of natural speech. Since a typical human voice varies over a range of fundamental frequencies, it is more accurate to speak of a person having a range of fundamental frequencies, rather than one specific fundamental frequency. Nevertheless, a relaxed voice is typically characterized by a natural (or nominal) fundamental frequency or pitch that is comfortable for that person. That is, the glottal pulses provide an underlying undulation to voiced speech corresponding to the pitch perceived by a listener.

As noted above, spoken communication typically occurs in the presence of noise and/or other interference. In turn, the undulation of voiced speech is masked in some portions of the frequency spectrum associated with human speech by noise and/or other interference. In some implementations, systems, method and devices are operable to identify voice activity by identifying the portions of the frequency spectrum associated with human speech that are unlikely to be masked by noise and/or other interference. To that end, in some implementations, systems, method and devices are operable to identify periodically occurring pulses in one or more sub-bands of the frequency spectrum associated with human speech corresponding to the spectral location of one or more respective formants. The one or more sub-bands including formants associated with a particular voiced sound will typically include more energy than the remainder of the frequency spectrum associated with human speech for the duration of that particular voiced sound. But the formant energy will also typically undulate according to the periodicity of the underlying glottal pulses.

More specifically, formants are the distinguishing frequency components of voiced sounds that make up intelligible speech, which are created by the vocal chords and other vocal track articulators using the air pressure from the lungs that was first modulated by the glottal pulses. In other words, the formants concentrate or focus the modulated energy from the lungs and glottis into specific frequency bands in the frequency spectrum associated with human speech. As a result, when a formant is present in a sub-band, the average energy of the glottal pulses in that sub-band rises to the energy level of the formant. In turn, if the formant energy is greater than the noise and/or interference, the glottal pulse energy is above the noise and/or interference, and is thus detectable as the time domain envelope of the formant.

Various implementations utilize a formant based voice model because formants have a number of desirable attributes. First, formants allow for a sparse representation of speech, which in turn, reduces the amount of memory and processing power needed in a device such as a hearing aid. For example, some implementations aim to reproduce natural speech with eight or fewer formants. On the other hand, other known model-based voice enhancement methods tend to require relatively large allocations of memory and tend to be computationally expensive.

Second, formants change slowly with time, which means that a formant based voice model programmed into a hearing aid will not have to be updated very often, if at all, during the life of the device.

Third, with particular relevance to voice activity detection and pitch detection, the majority of human beings naturally produce the same set of formants when speaking, and these formants do not change substantially is response to changes or differences in pitch between speakers or even the same speaker. Additionally, unlike phonemes, formants are language independent. As such, in some implementations a single formant based voice model, generated in accordance to the prominent features discussed below, can be used to reconstruct a target voice signal from almost any speaker without extensive fitting of the model to each particular speaker a user encounters.

Fourth, also with particular relevance to voice activity detection and pitch detection, formants are robust in the presence of noise and other interference. In other words, formants remain distinguishable even in the presence of high levels of noise and other interference. In turn, as discussed in greater detail below, in some implementations formants are relied upon to raise the glottal pulse energy above the noise and/or interference, making the glottal pulse peaks distinguishable after the processing included in various implementations discussed below.

Figure 1B:
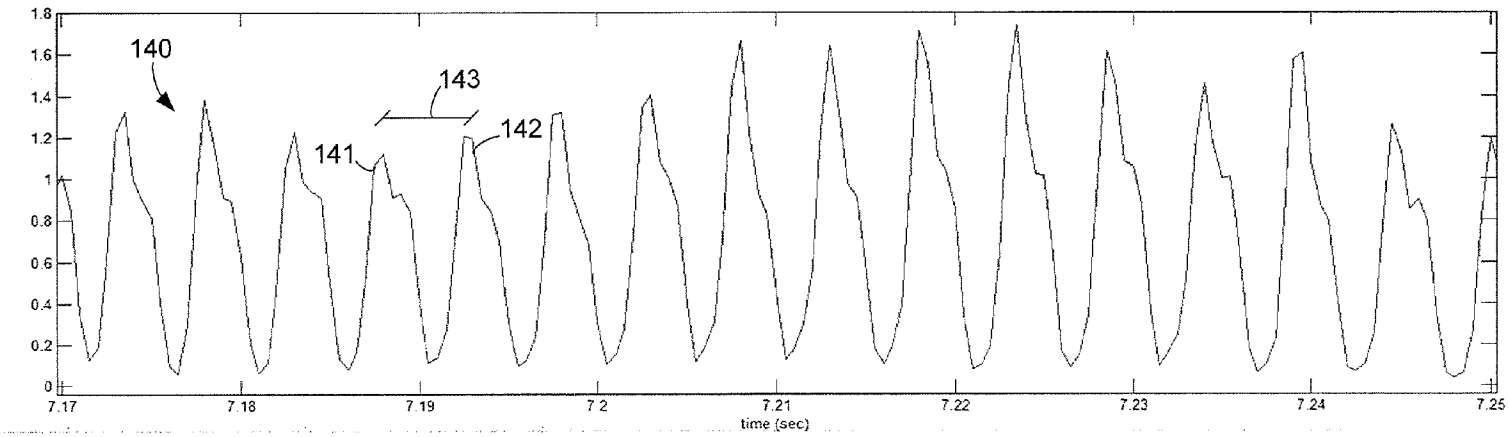
FIG. 1B is a time domain representation of a smoothed envelope associated with the simulated glottal pulse train of FIG. 1A.

FIG. 1A is a time domain representation of an example glottal pulse train 130. Those skilled in the art will appreciate that the glottal pulse train 130 illustrated in FIG. 1A includes both dominant peaks 131, 132 and minor peaks, such as for example, minor peak 134. In some implementations, it is assumed that the dominant peaks 131, 132 and the duration 133 between the dominant peaks can be used more reliably to detect voiced sounds because they have higher amplitudes, and are less likely to have been caused by secondary resonant effects in the vocal track as compared to the minor peaks 134. As such, in some implementations, as discussed below, the minor speaks 134 are removed by smoothing the envelope of the received audible signal on a sub-band basis. To that end, FIG. 1B is a time domain representation of a smoothed envelope 140 associated with the glottal pulse train 130 of FIG. 1A. The smooth peaks 141, 142 are somewhat time shifted relative to the dominant peaks 131, 132. However, the duration 143 between the smooth speaks is substantially equal to the duration 133 between the dominant peaks.

Those skilled in the art will also appreciate that a glottal pulse train will rarely, if ever, be audible independent of some form of intelligible speech, such as formants. As noted above, the energy of one or more formants that make up intelligible speech will likely be more detectable in a noisy audible signal, and the time-varying formant energy will also typically undulate according to the periodicity of the underlying glottal pulses. As such, the glottal pulse can be detected in the envelope of the time-varying formant energy detectable within a noisy signal.

Figure 1C:
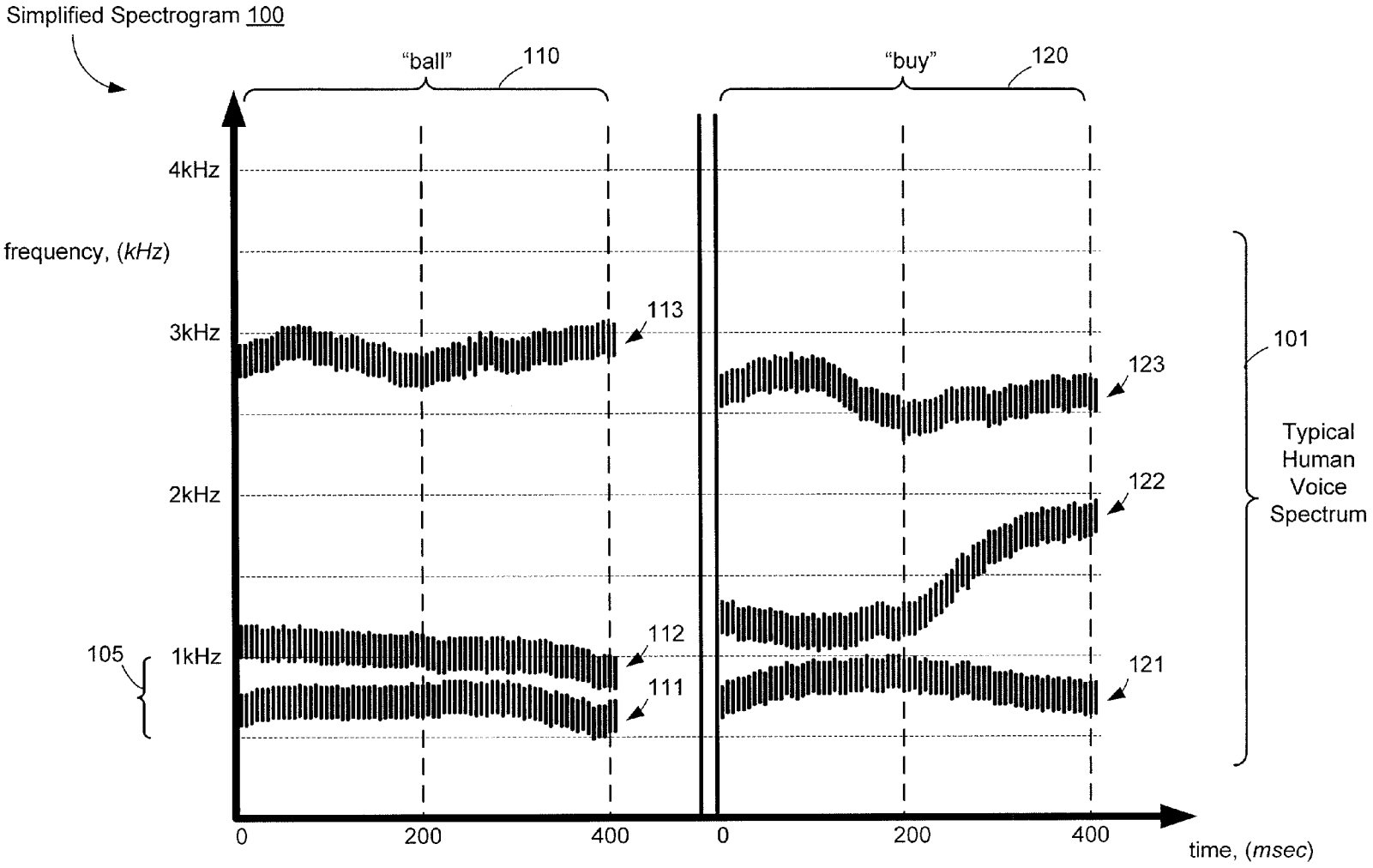
FIG. 1C is a simplified spectrogram showing example formants.

FIG. 1C is a simplified spectrogram 100 showing example formant sets 110, 120 associated with two words, namely, "ball" and "buy", respectively. Those skilled in the art will appreciate that the simplified spectrogram 100 includes merely the basic information typically available in a spectrogram. So while certain specific features are illustrated, those skilled in the art will appreciate from the present disclosure that various other features have not been illustrated for the sake of brevity and so as not to obscure more pertinent aspects of the spectrogram 100 as they are used to describe more prominent features of the various implementations disclosed herein. The spectrogram 100 does not include much of the more subtle information one skilled in the art would expect in a far less simplified spectrogram. Nevertheless, those skilled in the art would appreciate that the spectrogram 100 does include enough information to illustrate the differences between the two sets of formants 110, 120 for the two words. For example, as discussed in greater detail below, the spectrogram 100 includes representations of the three dominant formants for each word.

The spectrogram 100 includes the typical portion of the frequency spectrum associated with the human voice, the human voice spectrum 101. The human voice spectrum typically ranges from approximately 300 Hz to 3400 Hz. However, the bandwidth associated with a typical voice channel is approximately 4000 Hz (4 kHz) for telephone applications and 8000 Hz (8 kHz) for hear aid applications, which are bandwidths that are more conducive to signal processing techniques known in the art.

As noted above, formants are the distinguishing frequency components of voiced sounds that make up intelligible speech. Each phoneme in any language contains some combination of the formants in the human voice spectrum 101. In some implementations, detection of formants and signal processing is facilitated by dividing the human voice spectrum 101 into multiple sub-bands. For example, sub-band 105 has an approximate bandwidth of 500 Hz. In some implementations, eight such sub-bands are defined between 0 Hz and 4 kHz. However, those skilled in the art will appreciate that any number of sub-bands with varying bandwidths may be used for a particular implementation.

In addition to characteristics such as pitch and amplitude (i.e., loudness), the formants and how they vary in time characterize how words sound. Formants do not vary significantly in response to changes in pitch. However, formants do vary substantially in response to different vowel sounds. This variation can be seen with reference to the formant sets 110, 120 for the words "ball" and "buy." The first formant set 110 for the word "ball" includes three dominant formants 111, 112 and 113. Similarly, the second formant set 120 for the word "buy" also includes three dominant formants 121, 122 and 123. The three dominant formants 111, 112 and 113 associated with the word "ball" are both spaced differently and vary differently in time as compared to the three dominant formants 121, 122 and 123 associated with the word "buy." Moreover, if the formant sets 110 and 120 are attributable to different speakers, the formants sets would not be synchronized to the same fundamental frequency defining the pitch of one of the speakers.

Figure 2:
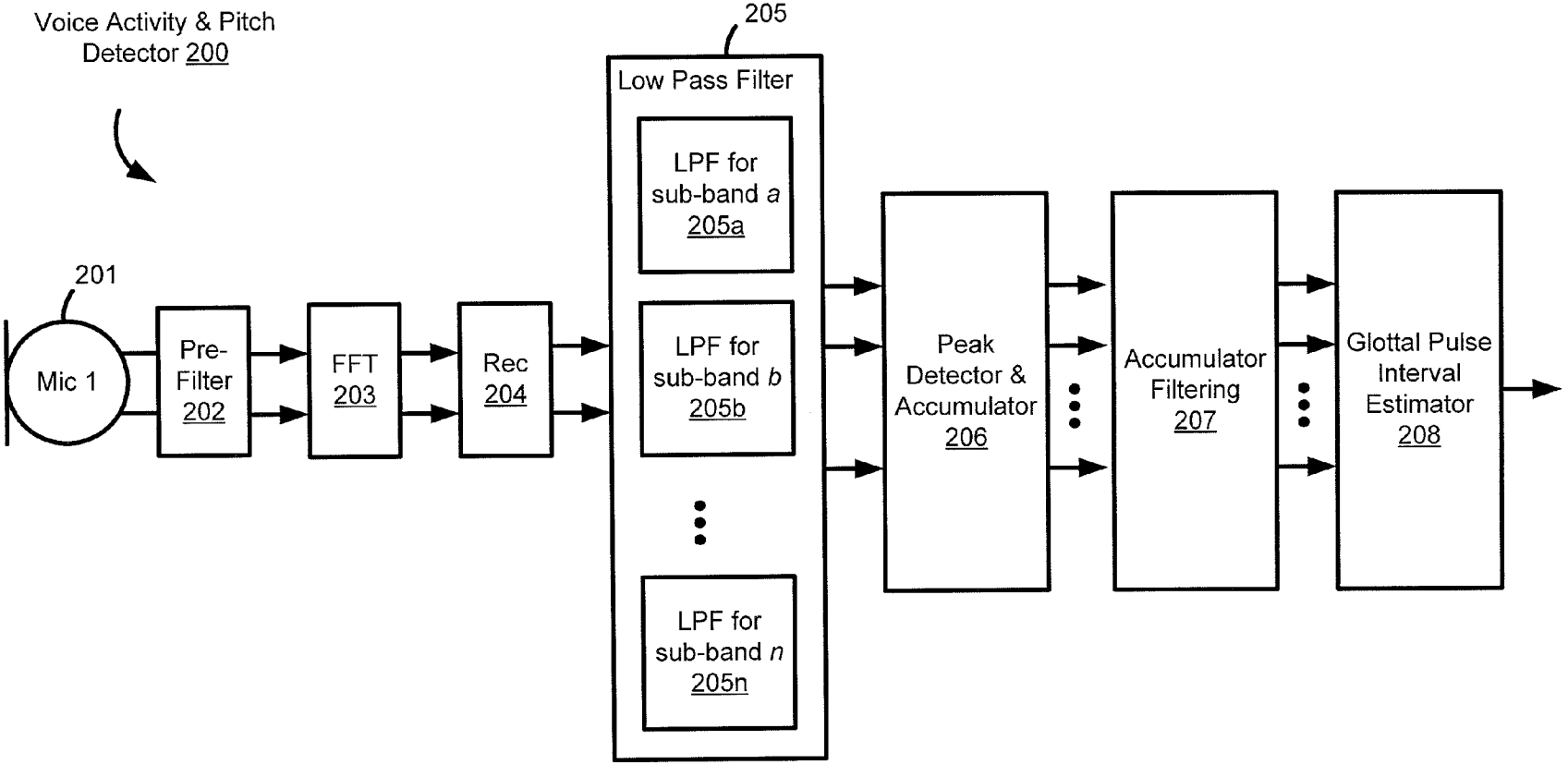
FIG. 2 is a block diagram of an implementation of a voice activity and pitch estimation system.

FIG. 2 is a block diagram of an implementation of a voice activity and pitch estimation system 200. While certain specific features are illustrated, those skilled in the art will appreciate from the present disclosure that various other features have not been illustrated for the sake of brevity and so as not to obscure more pertinent aspects of the example implementations disclosed herein. To that end, as a non-limiting example, in some implementations the voice activity and pitch estimation system 200 includes a pre-filtering stage 202 connectable to the microphone 201, a Fast Fourier Transform (FFT) module 203, a rectifier module 204, a low pass filtering module 205, a peak detector and accumulator module 206, an accumulation filtering module 206, and a glottal pulse interval estimator 208.

In some implementations, the voice activity and pitch estimation system 200 is configured for utilization in a hearing aid or similar device. Briefly, in operation the voice activity and pitch estimation system 200 detects the peaks in the envelope in a number of sub-bands, and accumulates the number of pairs of peaks having a given separation. In some implementations, the separation between pulses is within the bounds of typical human pitch, such as for example, 85 Hz to 255 Hz. In some implementations, that range is divided into a number of sub-ranges, such as for example 1 Hz wide "bins." The accumulator output is then smoothed, and the location of a peak in the accumulator indicates the presence of voiced speech. In other words, the voice activity and pitch estimation system 200 attempts to identify the presence of regularly-spaced transients generally corresponding to glottal pulses characteristic of voiced speech. In some implementation, the transients are identified by relative amplitude and relative spacing.

To that end, an audible signal is received by the microphone 201. The received audible signal may be optionally conditioned by the pre-filter 202. For example, pre-filtering may include band-pass filtering to isolate and/or emphasize the portion of the frequency spectrum associated with human speech. Additionally and/or alternatively, pre-filtering may include filtering the received audible signal using a low-noise amplifier (LNA) in order to substantially set a noise floor. Those skilled in the art will appreciate that numerous other pre-filtering techniques may be applied to the received audible signal, and those discussed are merely examples of numerous pre-filtering options available.

In turn, the FFT module 203 converts the received audible signal into a number of time-frequency units, such that the time dimension of each time-frequency unit includes at least one of a plurality of sequential intervals, and the frequency dimension of each time-frequency unit includes at least one of a plurality of sub-bands contiguously distributed throughout the frequency spectrum associated with human speech. In some implementations, a 32 point short-time FFT is used for the conversion. However, those skilled in the art will appreciate that any number of FFT implementations may be used. Additionally and/or alternatively, the FFT module 203 may be replaced with any suitable implementation of one or more low pass filters, such as for example, a bank of IIR filters.

The rectifier module 204 is configured to produce an absolute value (i.e., modulus value) signal from the output of the FFT module 203 for each sub-band.

The low pass filtering stage 205 includes a respective low pass filter 205*a*, 205*b*, . . . , 205*n* for each of the respective sub-bands. The respective low pass filters 205*a*, 205*b*, . . . , 205*n* filter each sub-band with a finite impulse response filter (FIR) to obtain the smooth envelope of each sub-band. The peak detector and accumulator 206 receives the smooth envelopes for the sub-bands, and is configured to identify sequential peak pairs on a sub-band basis as candidate glottal pulse pairs, and accumulate the candidate pairs that have a time interval within the pitch period range associated with human speech. In some implementations, accumulator also has a fading operation (not shown) that allows it to focus on the most recent portion (e.g., 20 msec) of data garnered from the received audible signal.

The accumulation filtering module 207 is configured to smooth the accumulation output and enforce filtering rules and temporal constraints. In some implementations, the filtering rules are provided in order to disambiguate between the possible presence of a signal indicative of a pitch and a signal indicative of an integer (or fraction) of the pitch. In some implementations, a separate disambiguation filter is provided to disambiguate between the possible presence of a signal indicative of a pitch and a signal indicative of an integer or fractional multiple of the pitch. In some implementations, the temporal constraints are used to reduce the extent to which the pitch estimate fluctuates too erratically. In some implementations, a low pass filter is then used to filter the output of the disambiguation filter.

The glottal pulse interval estimator 208 is configured to provide an indicator of voice activity based on the presence of detected glottal pulses and an indicator of the pitch estimate using the output of the accumulator filtering module 207. In some implementations, a pulse identification module is utilized as and/or within the glottal pulse interval estimator 208 to identify the highest amplitude pulse after low pass filtering, where the highest amplitude pulse is indicative of a dominant voice period in the audible signal.

Moreover, FIG. 2 is intended more as functional description of the various features which may be present in a particular implementation as opposed to a structural schematic of the implementations described herein. In practice, and as recognized by those of ordinary skill in the art, items shown separately could be combined and some items could be separated. For example, some functional blocks shown separately in FIG. 2 could be implemented in a single module and the various functions of single functional blocks (e.g., peak detector and accumulator 206) could be implemented by one or more functional blocks in various implementations. The actual number of modules and the division of particular functions used to implement the voice activity and pitch estimation system 200 and how features are allocated among them will vary from one implementation to another, and may depend in part on the particular combination of hardware, software and/or firmware chosen for a particular implementation.

Figure 3:
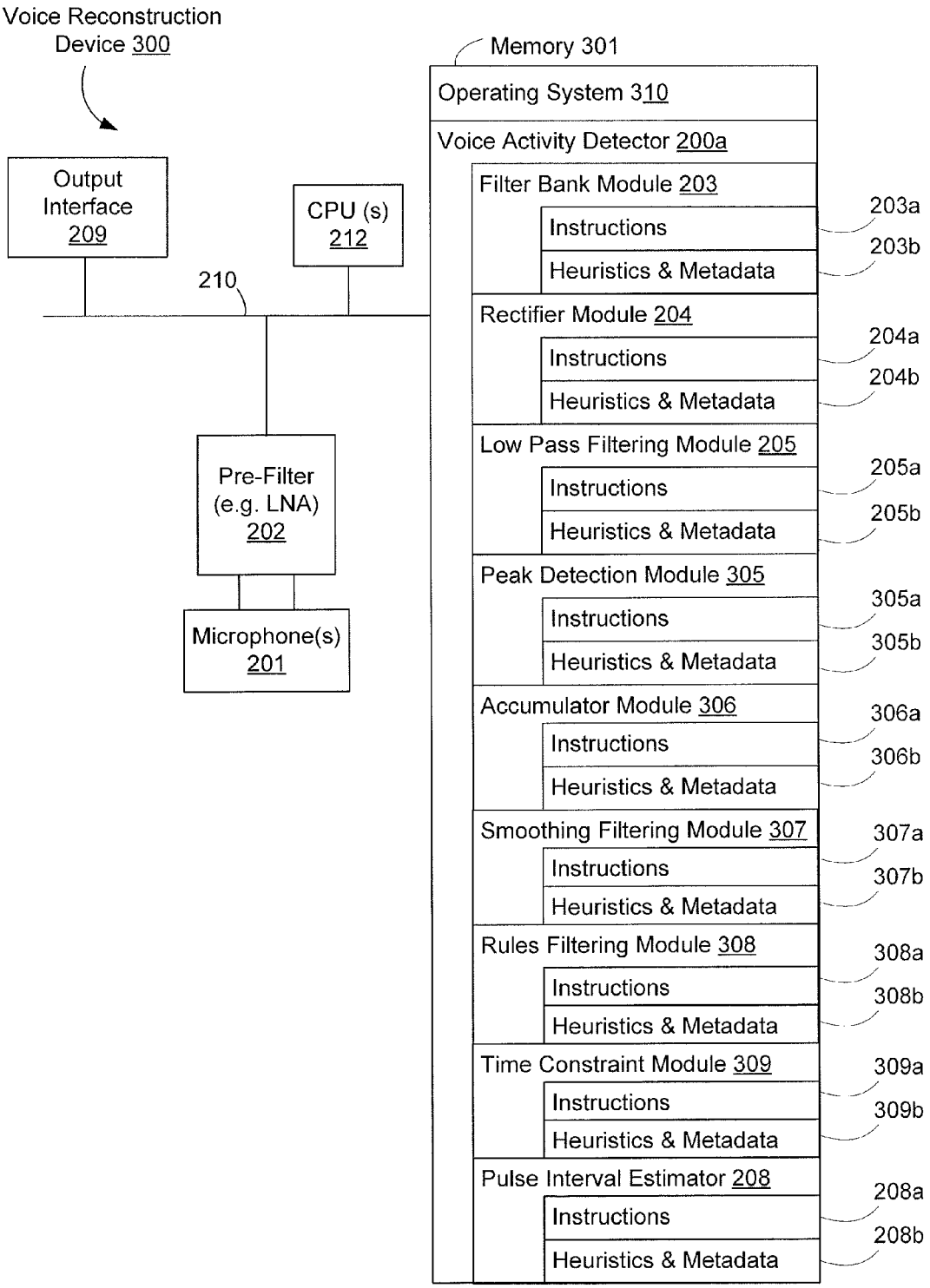
FIG. 3 is a block diagram of an implementation of a voice activity and pitch estimation system.

FIG. 3 is a block diagram of an implementation of a voice activity and pitch estimation system 300. The voice activity and pitch estimation system 300 illustrated in FIG. 3 is similar to and adapted from the voice activity and pitch estimation system 200 illustrated in FIG. 2. Elements common to both implementations include common reference numbers, and only the differences between FIGS. 2 and 3 are described herein for the sake of brevity. Moreover, while certain specific features are illustrated, those skilled in the art will appreciate from the present disclosure that various other features have not been illustrated for the sake of brevity, and so as not to obscure more pertinent aspects of the implementations disclosed herein.

To that end, as a non-limiting example, in some implementations the voice activity and pitch estimation system 200 includes one or more processing units (CPU's) 212, one or more output interfaces 209, a memory 301, the pre-filter 202, the microphone 201, and one or more communication buses 210 for interconnecting these and various other components.

The communication buses 210 may include circuitry that interconnects and controls communications between system components. The memory 301 includes high-speed random access memory, such as DRAM, SRAM, DDR RAM or other random access solid state memory devices; and may include non-volatile memory, such as one or more magnetic disk storage devices, optical disk storage devices, flash memory devices, or other non-volatile solid state storage devices. The memory 301 may optionally include one or more storage devices remotely located from the CPU(s) 212. The memory 301, including the non-volatile and volatile memory device(s) within the memory 301, comprises a non-transitory computer readable storage medium. In some implementations, the memory 301 or the non-transitory computer readable storage medium of the memory 301 stores the following programs, modules and data structures, or a subset thereof including an optional operating system 210, the FFT module 203, the rectifier module 204, the low pass filtering module 205, a peak detection module 305, an accumulator module 306, a smoothing filtering module 307, a rules filtering module 308, a time-constraint module 309, and the glottal pulse interval estimator 208.

The operating system 310 includes procedures for handling various basic system services and for performing hardware dependent tasks.

In some implementations, the FFT module 203 is configured to convert an audible signal, received by the microphone 201, into a set of time-frequency units as described above. As noted above, in some implementations, the received audible signal is pre-filtered by pre-filter 202 prior to conversion into the frequency domain by the FFT module 203. To that end, in some implementations, the FFT module 203 includes a set of instructions 203*a* and heuristics and metadata 203*b*.

The rectifier module 204 is configured to produce an absolute value (i.e., modulus value) signal from the output of the FFT module 203 for each sub-band. To that end, in some implementations, the rectifier module 204 includes a set of instructions 204*a* and heuristics and metadata 204*b*.

In some implementations, the low pass filtering module 205 is configured low pass filter the time-frequency units produced by the rectifier module 204 on a sub-band basis. To that end, in some implementations, the low pass filtering module 205 includes a set of instructions 205*a* and heuristics and metadata 205*b*.

In some implementations, the peak detection module 305 is configured to identify sequential spectral peak pairs on a sub-band basis as candidate glottal pulse pairs in the smooth envelope signal for each sub-band provided by the low pass filtering module 204. In other words, the peak detection module 305 is configured to search for the presence of regularly-spaced transients generally corresponding to glottal pulses characteristic of voiced speech. In some implementations, the transients are identified by relative amplitude and relative spacing. In some implementations, the transients are identified by calculating an autocorrelation coefficient ρ between segments centered on each transient. If the autocorrelation coefficient ρ is greater than a threshold (e.g., 0.5), then that value is added to an accumulation in a bin corresponding to a particular relative spacing. The autocorrelation operation reduces the impact on the accumulator output of spurious peaks that survive the low pass filtering. In some implementations, the peak detection module 305 includes a set of instructions 305*a* and heuristics and metadata 305*b*.

In some implementations, the accumulator module 306 is configured to accumulator the peak pairs identified by the peak detection module 305. In some implementations, accumulator module also is also configured with a fading operation that allows it to focus on the most recent portion (e.g., 20 msec) of data garnered from the received audible signal. To these ends, in some implementations, the accumulator module 306 includes a set of instructions 306*a* and heuristics and metadata 306*b*.

In some implementations, the smoothing filtering module 307 is configured to smooth the output of the accumulator module 306. In some implementations, the smoothing filtering module 307 utilizes an IIR filter along the time axis while adding each new entry (e.g., a leaky integrator), and a FIR filter along the period axis. To that end, in some implementations, the smoothing filtering module 307 includes a set of instructions 307*a* and heuristics and metadata 307*b*.

In some implementations, the rules filtering module 308 is configured to disambiguate between the actual pitch of a target voice signal in the received audible signal and integer multiples (or fractions) of the pitch. For example, a rule that may be utilized directs the system to select the lowest pitch value when there are multiple peaks in the accumulation output that correspond to whole multiples of at least one of the pitch values. To that end, in some implementations, the rules filtering module 308 includes a set of instructions 308*a* and heuristics and metadata 308*b*.

In some implementations, the time constraint module 309 is configured to limit or dampen fluctuations in the estimate of the pitch. For example, in some implementations, the pitch estimate is prevented from abruptly shifting more than a threshold amount (e.g., 16 octaves per second) between time frames. To that end, in some implementations, the time constraint module 309 includes a set of instructions 309*a* and heuristics and metadata 309*b*.

In some implementations, the pulse interval module 208 is configured to provide an indicator of voice activity based on the presence of detected glottal pulses and an indicator of the pitch estimate using the output of the time constraint module 309. To that end, in some implementations, the pulse interval module 208 includes a set of instructions 208*a* and heuristics and metadata 208*b*.

Moreover, FIG. 3 is intended more as functional description of the various features which may be present in a particular implementation as opposed to a structural schematic of the implementations described herein. In practice, and as recognized by those of ordinary skill in the art, items shown separately could be combined and some items could be separated. For example, some modules (e.g., FFT module 203 and the rectifier module 204) shown separately in FIG. 3 could be implemented in a single module and the various functions of single modules could be implemented by one or more modules in various implementations. The actual number of modules and the division of particular functions used to implement the voice activity and pitch estimation system 300 and how features are allocated among them will vary from one implementation to another, and may depend in part on the particular combination of hardware, software and/or firmware chosen for a particular implementation.

Figure 4:
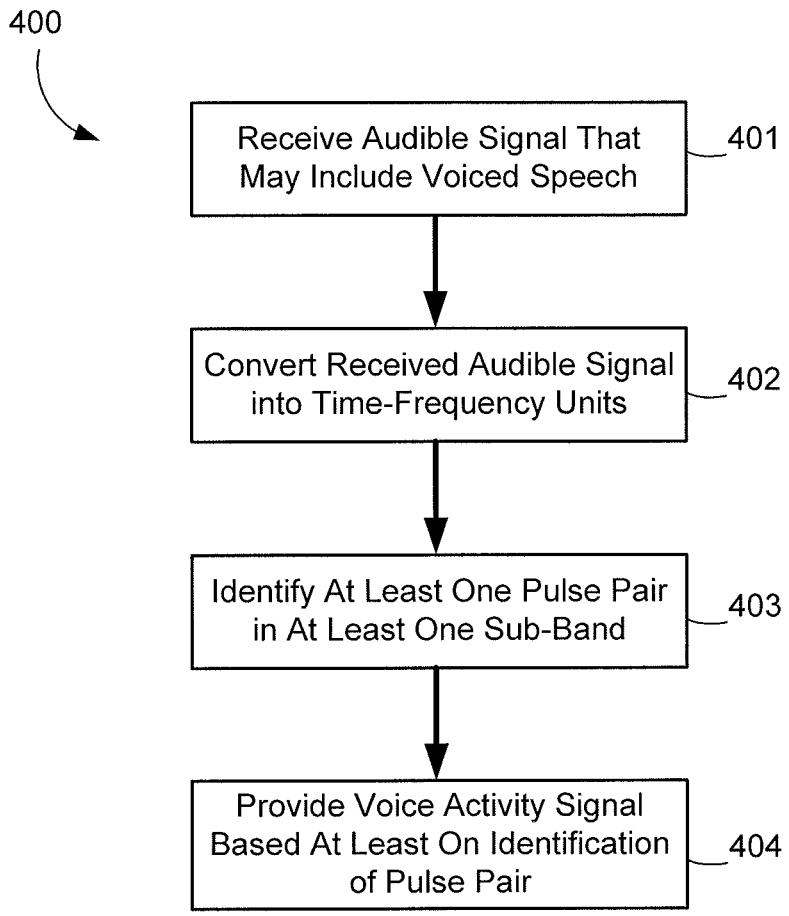
FIG. 4 is a flowchart representation of an implementation of a voice activity and pitch estimation system method.

FIG. 4 is a flowchart 400 of an implementation of a voice activity and pitch estimation system method. In some implementations, the method is performed by a voice activity detection system in order to provide a voice activity signal based at least on the identification of regularly-spaced transients generally characteristic of voiced speech. To that end, the method includes receiving an audible signal that may include voiced speech (401). Receiving the audible signal may include receiving the audible signal in real-time from a microphone and/or retrieving a recording of the audible signal from a storage medium. The method includes converting the received audible signal into time-frequency units (402), which, for example, may occur before or after retrieving the audible signal from a storage medium in some embodiments. The method includes at least one pulse pair in at least one sub-band, as representative of an instance of regularly-spaced transients generally characteristic of voiced speech (403). Subsequently, the method includes providing a voice activity signal at least in response to the identification of at least one pulse pair in at least one sub-band (404).

Figure 5:
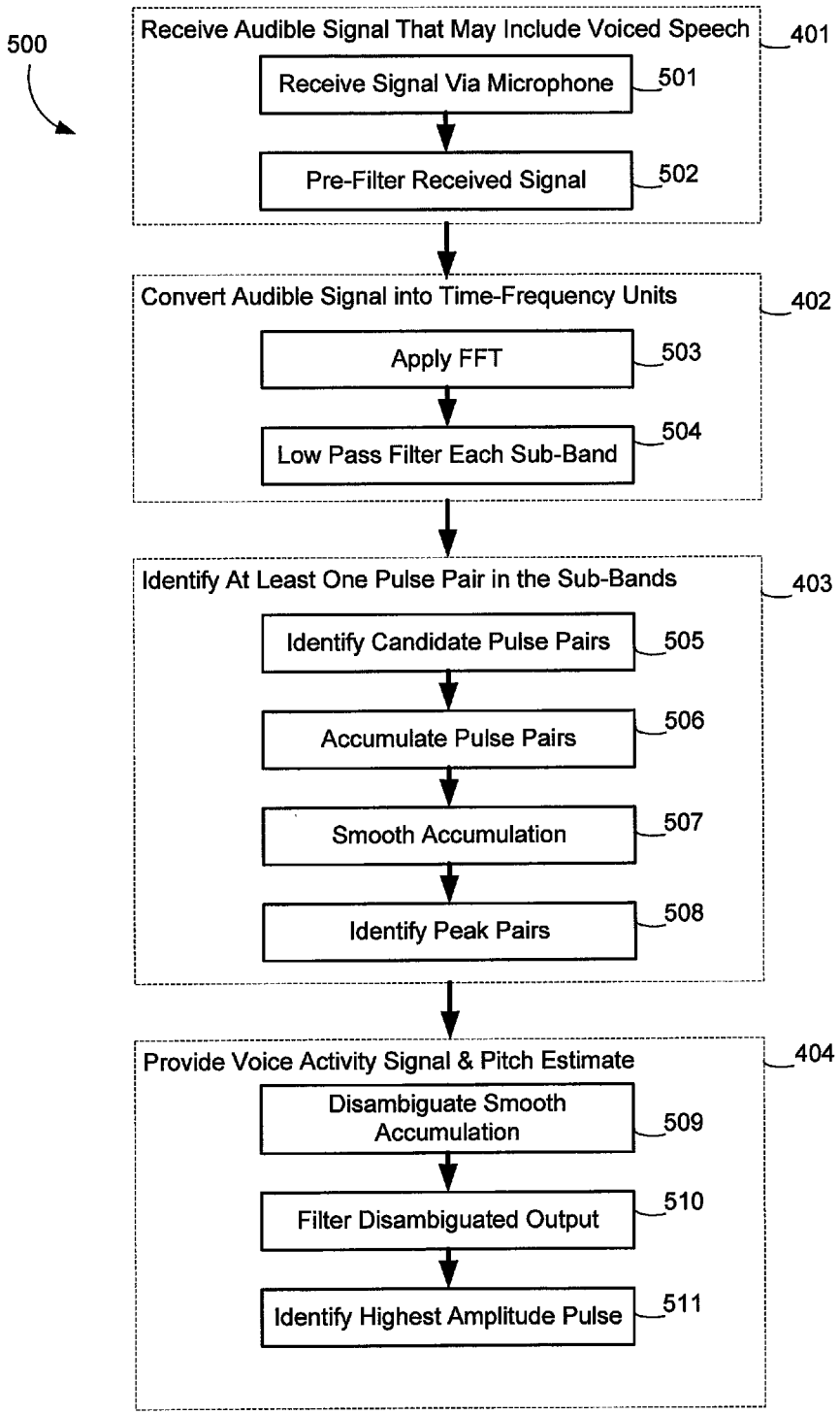
FIG. 5 is a flowchart representation of an implementation of a voice activity and pitch estimation system method.

FIG. 5 is a flowchart 500 of an implementation of a voice activity and pitch estimation system method. In some implementations, the method is performed by a voice activity detection system in order to provide a voice activity signal based at least on the identification of regularly-spaced transients generally characteristic of voiced speech.

The method includes, for example, receiving an audible signal via a microphone or the like (501), and pre-filtering the received audible signal as discussed above (502). The method includes converting the pre-filtered received audible signal into a set of time-frequency units as discussed above (503). In turn, the method includes low pass filtering the time frequency units on a sub-band basis in order to smooth the envelope of each constituent sub-band signal (504). Analyzing the smooth envelopes, the method includes identifying candidate pulse pairs (505), and accumulating the candidate pulse pairs (506). The method then includes smoothing (i.e., filtering) the accumulation of the candidate pulse pairs on a sub-band basis as discussed above (507), and then identifying peaks pairs in the smoothed accumulation on a sub-band basis (508). The presence of at least one peaks pair in the smoothed accumulation for at least one sub-band is indicative of voice activity in the audible signal.

In some implementations, merely detecting voice activity is sufficient, and a voice activity signal merely indicates that voice activity has been detected. In some implementations, the method is furthered to provide an estimate of the pitch associated with the detected voice activity. As such, the method includes estimating the pitch from the smoothed accumulation on either a sub-band basis or in aggregate across all sub-bands by disambiguating the smoothed accumulation output for a sub-band (509), filtering the normalized output by preventing unnatural pitch transitions (510), and subsequently identifying the highest amplitude pulse (511), which is indicative of the pitch estimate. In some implementations, a pulse identification module is utilized to identify the highest amplitude pulse after low pass filtering, where the highest amplitude pulse is indicative of a dominant voice period in the audible signal.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, which changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A method of detecting voice activity in an audible signal, the method comprising:

converting an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands, wherein converting the audible signal into the corresponding plurality of time-frequency units includes applying a signal decomposition to the audible signal;

low pass filtering each of the time-frequency units to obtain a respective frequency domain envelope for each of the plurality of sequential intervals;

identifying at least one pulse pair in the plurality of time-frequency units characterized by regularly spaced transients over multiple time intervals on a sub-band basis, wherein the presence of a pulse pair is indicative of voiced speech, and wherein the regularly spaced transients correspond to glottal pulses with a frequency range associated with human voice; and providing a voice activity signal indicator based at least in part on the presence of a pulse pair in order to further the operation of an auditory processing system.

2. The method of claim 1, further comprising receiving the audible signal from a single audio sensor device.

3. The method of claim 1, further comprising receiving the audible signal from a plurality of audio sensors.

4. The method of claim 1, wherein the plurality of sub-bands is contiguously distributed throughout the frequency spectrum associated with human speech.

5. The method of claim 1, further comprising at least one of amplitude and frequency filtering the audible signal prior to converting the audible signal into the corresponding plurality of time-frequency units.

6. The method of claim 1, wherein the signal decomposition includes a Fast Fourier Transform.

7. The method of claim 1, wherein each of the plurality of sequential intervals has the same duration.

8. The method of claim 1, wherein identifying at least one pulse pair comprises:

identifying one or more pulses as candidate glottal pulses in the envelope of the frequency-domain signal for each interval;

accumulating the one or more pulse pairs having a given separation over sequential intervals on a sub-band basis;

smoothing the accumulation of one or more pulses; and identifying at least one pulse pair in the smoothed accumulation of one or more pulses.

9. The method of claim 8, further comprising determining a value indicative of a dominant voice period by:

disambiguating the smoothed accumulation of one or more pulses;

filtering the normalized smoothed accumulation of one or more pulses;

identifying the highest amplitude pulse after filtering, wherein the highest amplitude pulse is indicative of the dominant voice period.

10. The method of claim 9, wherein normalizing comprises performing a zero-mean.

11. A voice activity detector comprising:

a conversion module, including a processing unit, configured to convert an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands, wherein converting the audible signal into the corresponding plurality of time-frequency units includes applying a signal decomposition to the audible signal;

a low pass filtering module configured to low pass filter each of the time-frequency units to obtain a respective frequency domain envelope for each of the plurality of sequential intervals;

a peak detection module configured to identify one or more pulses as candidate glottal pulses in the envelope of the frequency-domain signal for each interval;

an accumulation module configured to sum one or more pulse pairs having a given separation over sequential intervals on a sub-band basis;

a pulse pair detection module configured to identify at least one pulse pair in the accumulation of one or more pulses, wherein the at least one pulse pair is characterized by regularly spaced transients corresponding to glottal pulses with a frequency range associated with human voice; and an indicator module for providing a voice activity signal indicator based at least in part on the presence of a pulse pair in order to further the operation of an auditory processing system.

12. The voice activity detector of claim 11, further comprising:

a disambiguation filter configured to disambiguate between a signal component indicative of pitch and a signal component indicative of an integer or fractional multiple of the pitch;

a low pass filter configured to filter the output of the disambiguation filter; and a pulse identification module configured to identify the highest amplitude pulse after low pass filtering, wherein the highest amplitude pulse is indicative of a dominant voice period in the audible signal.

13. The voice activity detector of claim 11, wherein the signal decomposition includes a Fast Fourier Transform.

14. A voice activity detector comprising:

means for converting an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands, wherein converting the audible signal into the corresponding plurality of time-frequency units includes applying a signal decomposition to the audible signal;

means for low pass filtering each of the time-frequency units to obtain a respective frequency domain envelope for each of the plurality of sequential intervals;

means for identifying one or more pulses as candidate glottal pulses in the envelope of the frequency-domain signal for each interval;

means for accumulating one or more pulse pairs having a given separation over sequential intervals on a sub-band basis;

means for identifying at least one pulse pair in the accumulation of one or more pulses, wherein the at least one pulse pair is characterized by regularly spaced transients corresponding to glottal pulses with a frequency range associated with human voice; and means for providing a voice activity signal indicator based at least in part on the presence of a pulse pair in order to further the operation of an auditory processing system.

15. A voice activity detector comprising:

a processor;

a memory including instructions, that when executed by the processor cause the voice activity detector to:

convert an audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands, wherein converting the audible signal into the corresponding plurality of time-frequency units includes applying a signal decomposition to the audible signal;

low pass filter each of the time-frequency units to obtain a respective frequency domain envelope for each of the plurality of sequential intervals;

identify one or more pulses as candidate glottal pulses in the envelope of the frequency-domain signal for each interval; accumulate one or more pulse pairs having a given separation over sequential intervals on a sub-band basis; and identify at least one pulse pair in the accumulation of one or more pulses, wherein the at least one pulse pair is characterized by regularly spaced transients corresponding to glottal pulses with a frequency range associated with human voice; and provide a voice activity signal indicator based at least in part on the presence of a pulse pair in order to further the operation of an auditory processing system.

* * * * *